US007591380B2

(12) United States Patent
Bennett

(10) Patent No.: US 7,591,380 B2
(45) Date of Patent: Sep. 22, 2009

(54) RECOVERY OF REPROCESSABLE MEDICAL DEVICES IN A SHARPS CONTAINER

(75) Inventor: Gregg D. Bennett, Bellevue, WA (US)

(73) Assignee: ClearMedical, Inc., Bellevue, WA (US)

( * ) Notice: Subject to any disclaimer, the term of this patent is extended or adjusted under 35 U.S.C. 154(b) by 549 days.

(21) Appl. No.: 10/943,586

(22) Filed: Sep. 17, 2004

(65) Prior Publication Data

US 2006/0070933 A1 Apr. 6, 2006

(51) Int. Cl.
*B07C 5/36* (2006.01)
*B07C 7/00* (2006.01)

(52) U.S. Cl. ..... 209/617; 209/630; 209/702; 209/703

(58) Field of Classification Search ..... 209/3, 209/617, 630, 702, 703, 942
See application file for complete search history.

(56) References Cited

U.S. PATENT DOCUMENTS

| | | | | | |
|---|---|---|---|---|---|
| 4,867,384 | A | | 9/1989 | Waltert | 241/24 |
| 4,929,342 | A | | 5/1990 | Johnston | 209/12 |
| 5,064,124 | A | | 11/1991 | Chang | |
| 5,205,417 | A | * | 4/1993 | Herren | 209/630 |
| 5,249,690 | A | | 10/1993 | Patterson | 209/630 |
| 5,454,000 | A | * | 9/1995 | Dorfman | 714/54 |
| 5,508,004 | A | | 4/1996 | Held et al. | 422/22 |
| 5,543,111 | A | | 8/1996 | Bridges et al. | 422/22 |
| 5,551,355 | A | * | 9/1996 | Haines et al. | 110/242 |
| 5,676,255 | A | * | 10/1997 | Flowers | 209/2 |
| 5,833,922 | A | * | 11/1998 | Held et al. | 422/22 |
| 6,149,017 | A | * | 11/2000 | Manka | 209/630 |
| 6,779,668 | B2 | | 8/2004 | Nagler | 209/617 |
| 7,018,592 | B2 | * | 3/2006 | Bowen | 422/295 |
| 7,103,023 | B2 | * | 9/2006 | Sakakura | 370/331 |
| 7,119,689 | B2 | | 10/2006 | Mallett et al. | 340/572.1 |
| 7,123,150 | B2 | * | 10/2006 | Mallett et al. | 340/572.1 |
| 7,170,023 | B1 | * | 1/2007 | Drake et al. | 209/584 |
| 7,303,081 | B2 | * | 12/2007 | Mallett et al. | 209/702 |
| 2003/0124025 | A1 | | 7/2003 | Mize et al. | 422/28 |
| 2005/0065820 | A1 | | 3/2005 | Mallett et al. | 705/2 |
| 2005/0080520 | A1 | | 4/2005 | Kline et al. | 701/1 |
| 2005/0216369 | A1 | | 9/2005 | Honegger | 705/28 |

FOREIGN PATENT DOCUMENTS

| | | |
|---|---|---|
| JP | 2002355614 | 12/2002 |
| WO | WO 01/87719 | 11/2001 |

* cited by examiner

*Primary Examiner*—Patrick H Mackey
*Assistant Examiner*—Terrell H Matthews
(74) *Attorney, Agent, or Firm*—Ronald M. Anderson

(57) ABSTRACT

A recovery device and method of use ensure that any reprocessable medical device that has been disposed of in a sharps container is recovered, cleaned, sterilized, and repackaged for reuse. In one embodiment, a sharps container and sorting surface are manipulated to rotate together and independently, so that the content of the sharps container are emptied onto the sorting surface, enabling an operator to manually, safely, efficiently, and timely retrieve reprocessable medical devices from the sorting surface and place these medical devices into a receptacle bin. The non-reprocessable contents are subsequently dumped into a waste bin, whose contents will subsequently be incinerated or otherwise destroyed. The operator of the recovery device is protected by a shield and an exhaust system that minimize the operator's exposure to airborne biohazardous toxins and enable the sorting to be done without injury to the operator from sharp medical devices.

20 Claims, 9 Drawing Sheets

RECOVERY OF REPROCESSABLE MEDICAL DEVICES IN A SHARPS CONTAINER

FIELD OF THE INVENTION

The present invention relates to recovering single use medical devises (SUDs) from existing hospital medical waste streams, and more specifically, to an apparatus and method to recover SUDs, which would otherwise be destroyed along with other medical waste contained within sealed sharps containers.

BACKGROUND OF THE INVENTION

Health care organizations are continually under pressure to find ways to lower or limit health care costs. One such opportunity for health care organizations to reduce costs is by recycling materials and supplies, in particular, by recovering SUDs that can be cleaned and sterilized for reuse, consistent with FDA regulations. Chapter 9 of the Federal Food, Drug and Cosmetic Act defines a medical device as an instrument, apparatus, implement, machine, contrivance, implant, in vitro reagent, or other similar or related article, including any component, part, or accessory, which is (1) recognized in the official National Formulary, or the United States Pharmacopeia, or any supplement to them, (2) intended for use in the diagnosis of disease or other conditions, or in the cure, mitigation, treatment, or prevention of disease, in man or other animals, or (3) intended to affect the structure or any function of the body of man or other animals, and which does not achieve its primary intended purposes through chemical action within or on the body of man or other animals and which is not dependent upon being metabolized for the achievement of its primary intended purposes.

For purposes of this patent application, medical devices fall into two categories. The first category is Reusable devices, which are sold as reusable and can be cleaned and sterilized for reuse by a health care organization, such as a hospital, without regulatory approval. Reusable, manufacturer designated multiple-use medical devices are sold with the expectation the medical devices can and will be processed for reuse by hospitals or surgery centers within their own walls. Such medical devices are sold once and are typically cleaned and resterilized many times for use on multiple patients. These medical devices are collected after use by hospital or surgery center personnel and are cleaned, resterilized in an autoclave or by exposure to ethylene oxide or other appropriate sterilant, repackaged as necessary, and then reused in the same facility.

The second category is reprocessable devices, which are designated by the manufacturer for single use only or as disposable; these medical devices can legally be reused only if reprocessed consistent with FDA regulations. These SUDs are designated for only a single use, but many can, if properly cleaned and sterilized by a regulated process, be recycled for additional patient use. The FDA closely regulates the third party reprocessing industry that provides this service by requiring separate regulatory approvals for each device-type SUD to be reprocessed. An FDA approval (which is obtained through an FDA 510*k* application) for such devices is a premarket notification by the FDA that is issued in response to a party demonstrating that a medical device the party wants to sell/reprocess is as safe and as effective as or substantially equivalent to an existing approved medical device that was or is currently on the United States market. Because hospitals do not have FDA 510*k* authorizations to reprocess SUDs, and because it does not appear that any hospital has applied for and received any FDA 510*k* authorizations to reprocess SUDs, a third party reprocessor industry has evolved with the engineering/regulatory infrastructure necessary to submit and receive multiple FDA 510*k* approvals, enabling these third parties to reprocess SUDs devices for the benefit of the medical industry.

Because medical devices are often "sharp" and used on patients in invasive procedures, there strict requirements exist for their disposal after use. After use, such medical devices are unclean, often having been in contact with blood or other bodily fluids of a patient, but are still sharp. Indeed, many of these medical devices have a point or edge sharp enough to penetrate typical waste collection containers. Accordingly, hospital procedures require that a large proportion of such SUDs be disposed after use in a "sharps" container. Sharps containers are well known to those who work in medical care facilities and are intended to be used to collect potentially dangerous, used sharp medical devices that are capable of cutting or penetrating skin or penetrating a conventional waste package container. Typically, sharps containers contain a large volume of used syringes, needles, and broken glass. They also often contain used SUDs. These containers are periodically picked up from the facility by a regulated waste collector and transported to a central site for permanent destruction.

Traditionally, there are two ways medical care facilities contract for waste collection and management of sharps containers. Medical care facilities can purchase sharps containers intended for disposal in a variety of sizes, as needed, and position the sharps containers inside patient rooms, laboratories, operating rooms, emergency rooms, etc. Medical care facilities personnel regularly monitor the status of individual sharps containers and collect them after they are full or after a predefined time perioed has elapsed. These containers are permanently "locked" at the point of collection, and a replacement empty sharps container is substituted for the full sharps container. These full, sharps containers intended for disposal, after being permanently sealed, are aggregated in a designated area for collection by a regulated medical waste hauler, who picks up the full sharps containers and transports them to a disposal plant. The sharps containers and their contents are then incinerated or otherwise completely destroyed without the containers ever being opened.

Alternatively, medical care facilities may choose to rent reusable sharps containers, rather than purchase sharps containers that are intended for disposal. At the disposal site, the lids of the reusable sharps containers are removed with a specially designed mechanical apparatus and all of the contents is dumped directly into a waste disposal stream for immediate or near-immediate permanent disposal. The reusable sharps containers are then cleaned and disinfected and returned to a hospital or other medical care facility for reuse.

Although the reprocessing of SUDs is certainly more cost effective than the alternative of destruction, a study conducted in coordination with New York State environmental regulators determined that a very large number of potentially reprocessable SUDs were being disposed of in sharps containers and thus never reclaimed for reuse. In this study, sharps containers were accumulated from ten New York City hospitals for one week. Next, the sharps containers were forcibly opened, and the contents spread out on a stainless steel tray and sorted into two piles, including a pile of reprocessable SUDs, and a pile of all the other contents. Approximately twenty percent by volume of the contents of these containers were SUDs that, if properly reprocessed, could save the hospital approximately $1000 per sharps container.

This figure equates to a savings of approximately $1,500 per hospital bed per year, or a $300,000 savings for a typical 200 bed hospital.

Therefore, it clearly would be desirable to provide a method and device that recovers SUDs from either disposal or reusable sharps containers. It would be desirable to substantially eliminate the need to purchase new SUDs and avoid the unnecessary waste by efficiently collecting and reprocessing SUDs that are reclaimed from sharps containers otherwise slated for destruction. It should be possible for medical care treatment facilities to proactively dispose of all SUDs in sharps containers. The sharps containers might then be collected, the contents removed and sorted, and all SUDs reprocessed for reuse. All of the remaining contents of the sharps containers, including the non-reusable medical devices and other medical waste, might then be disposed of using traditional disposal methods, such as incineration.

SUMMARY OF THE INVENTION

Recognizing a need to lower or at least limit medical care treatment costs, the present invention was thus developed to recycle and reprocess SUDs, which have been used in medical care treatments and disposed of in a sharps containers. One aspect of the invention is directed to a method for recovering medical devices that can be processed for reuse from a sharps container, which includes other medical waste materials that are to be destroyed. The sharps container is placed in a recovery device that facilitates handling of the sharps container and its contents in a manner that protects an operator from exposure to biohazards. The sharps container is then opened while in the recovery device. The recovery device is used to empty the contents of the sharps container onto a sorting surface that is disposed adjacent to the operator so that the operator is able to sort through the contents and manually remove any medical devices that are suitable for processing and reuse from the sorting surface, to an adjacent location. The other medical devices and medical waste remaining on the sorting surface are then placed in a disposal container.

In addition, the method includes the step of identifying a source of each sharps container that was submitted for disposal before the sharps container is placed in the recovery device, so that all medical devices that are removed from the sharps container for processing and reuse, and collected in a receptacle, are attributed to the source. These devices are cleaned and disinfected and are then eligible to be shipped by a common carrier without being labeled as biohazard infectious waste, in accordance with government regulations. In the alternative, the devices are shipped to another facility where they are cleaned, and disinfected for reuse.

Air is preferably exhausted from the vicinity of the sharps container and the sorting surface so that any aerosolized pathogens are exhausted before contacting the operator. This air is preferably exhausted through a filter that intercepts pathogens carried by the air before the air reaches the ambient environment.

When the sharps container is emptied, the sharps container is engaged with the recovery device, which manipulates the sorting surface so that it is positioned over an opening into the sharps container. The recovery device next manipulates the sharps container so that the contents of the sharps container move from inside the sharps container, through the opening, and fall onto the sorting surface. Finally, the sharps container is moved away from the sorting surface, enabling the operator to access any reusable medical devices that are on the sorting surface.

Any portion of the contents of the sharps container that has not fallen onto the sorting surface is manually removed. The empty sharps container and its lid are then queued for cleaning or destruction consistent with whether the sharps container is intended for disposal or reuse.

Medical devices that can be found in a sharps container, but which may be reused, include trocars, laparoscopic devices, endoscopic devices, cutters, staplers, graspers, harmonic scalpels, burrs, blades, oxisensors, compression sleeves, catheters, bits, and saws.

A second aspect of this invention is directed towards a recovery device for recovering medical devices that can be processed for reuse from a sharps container, which includes other medical devices and medical waste materials that are to be destroyed. It includes a frame and a movable support member mounted on the frame and adapted to removably engage a sharps container. A sorting surface is movably coupled to the frame to receive the contents of a sharps container when the movable support surface is reoriented to transfer the contents onto the sorting surface.

The device also includes a first operator manipulative control that moves the sorting surface into a first position relative to the movable support member. While in the first position, the sorting surface overlies an opening in a sharps container. It also includes a second operator manipulative control that moves the movable support member to different orientations. This second operative manipulative control is operable to selectively move the movable support member and the sorting surface to a second position that enables any liquid contained within a sharps container to drain, and to a third position in which contents of a sharps container are transferred to the sorting surface.

The frame further comprises a support for a removable receptacle. The receptacle is adapted to receive medical devices that can be processed for reuse after they are transferred from the sorting surface. The recovery device also includes an exhaust fan and vent such that air is exhausted from a vicinity of a sharps container and the sorting surface to prevent any aerosolized pathogens in the air from contacting an operator. A filter is disposed in a path of the air that is being exhausted to prevent any pathogens carried by the air from being exhausted into an ambient environment, and a shield is disposed around a sharps container and the sorting surface to protect an operator from exposure to pathogens. An opening between the shield and the sorting surface provides an operator unobstructed access to the contents of the sorting surface. Also, the movable support member defines an opening sized to receive and retain a sharps container. The frame includes an opening adapted to enable the other medical devices and medical waste materials to be transferred into a container for disposal.

The sorting surface is sized to cover an opening in a sharps container. The opening provides access to contents of a sharps container. The sorting surface also includes an opening to facilitate transfer of the other medical devices and medical waste materials into the container for disposal.

BRIEF DESCRIPTION OF THE DRAWING FIGURES

The foregoing aspects and many of the attendant advantages of this invention will become more readily appreciated as the same becomes better understood by reference to the following detailed description, when taken in conjunction with the accompanying drawings, wherein.

Figure 8:
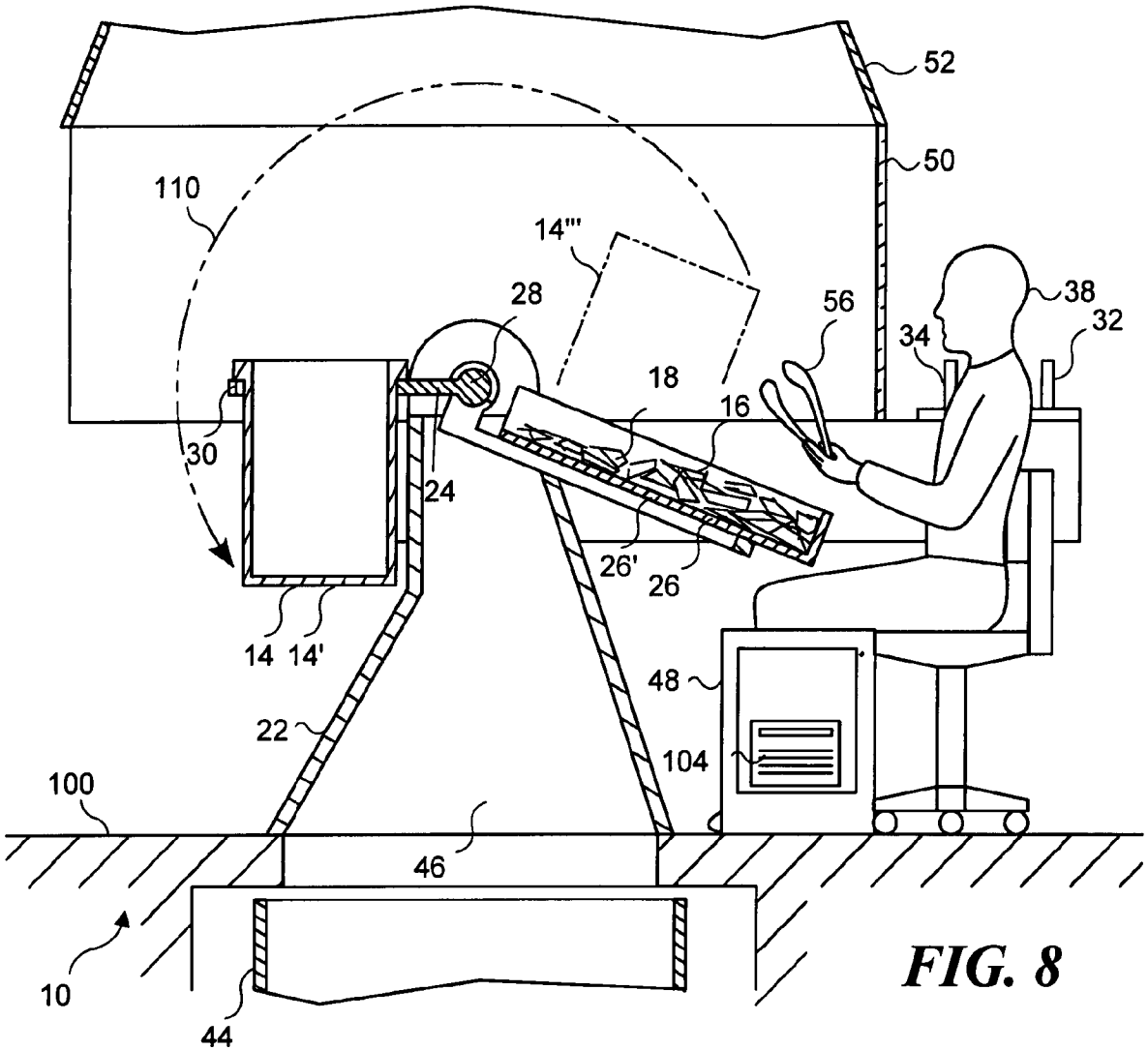
Figure 9:
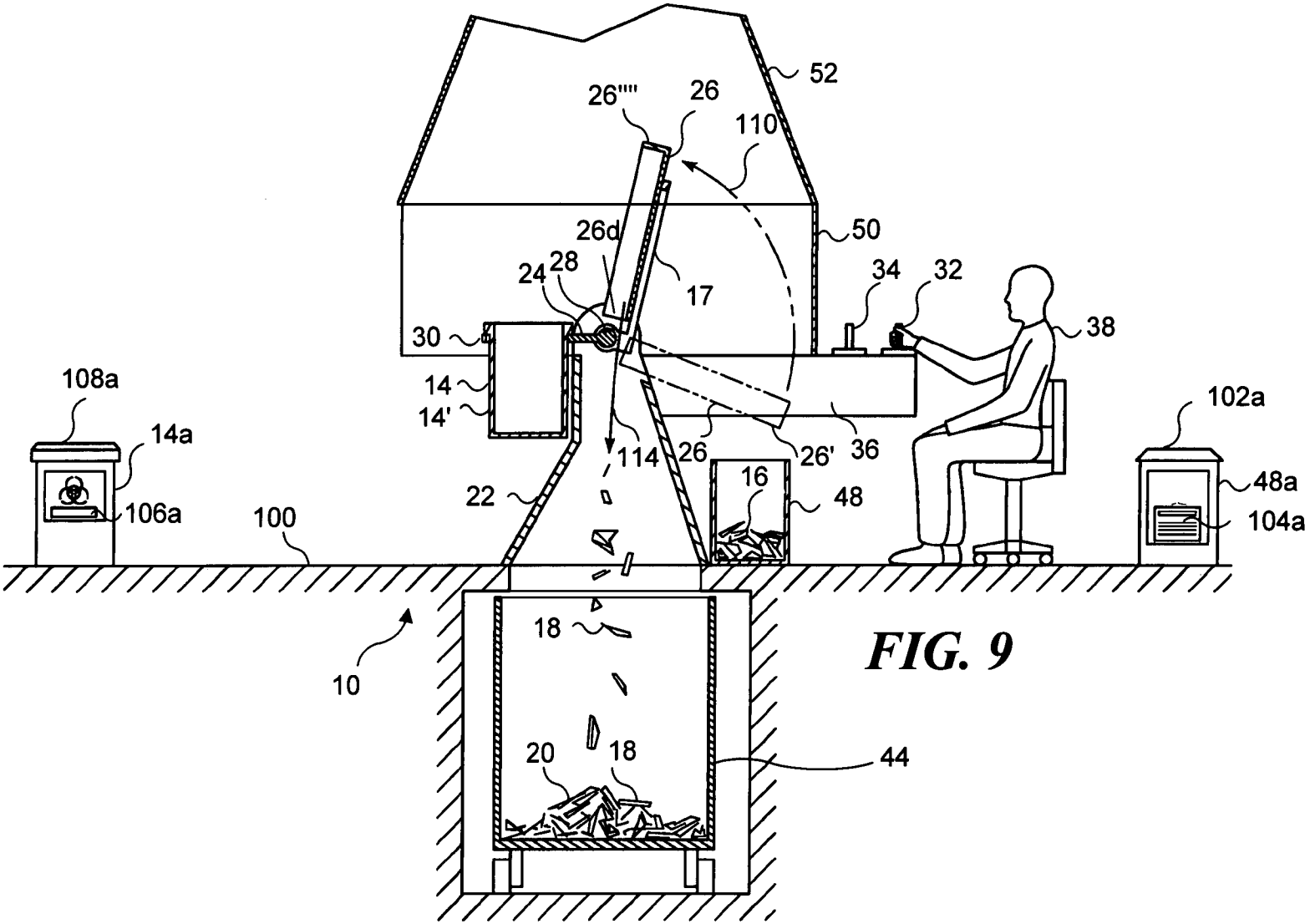

FIG. 8 is a schematic plan view showing an operator sorting the contents of the sharps container that have been deposited onto the sorting surface; and FIG. 9 is a schematic plan view showing the operator manipulating the recovery device so that the non-reprocessable medical devices and other medical wastes that are left on the sorting surface after the sorting routine is completed are deposited into a waste bin.

DESCRIPTION OF THE PREFERRED EMBODIMENT

Applicability of the Present Invention

The present invention provides a safe and efficient method and apparatus whereby a sharps container whose contents would otherwise be incinerated or permanently disposed of, can be opened and sorted to separate SUDs that can be cleaned and sterilized for use from all other medical waste that should be destroyed. A sharps container is a basic container that is well known in the medical arts, for disposal of items with a sharp edge or point that is capable of cutting or piercing. The sharps container is typically made of a relatively hard plastic so that these used medical devices are safely contained within the sharps container and therefore not likely to penetrate the sides of the container, which could injure and/or transmit biohazard contaminants to people.

Sharps containers are generally intended to contain items such as hypodermic needles, syringes (both with and without needles attached), scalpels, pipettes, blood vials, broken glassware such as flasks, beakers, and specimen tubes, culture dishes, IV tubing, IV bags contaminated with visible blood, and dental wires. These medical devices are non-reprocessable and are properly intended to be permanently disposed of, usually by incineration. However, in addition to these properly non-reprocessable medical items, there may be medical devices that are suitable for cleaning and reuse, such as trocars, laparoscopic and endoscopic devices, cutters, staplers, graspers, harmonic scalpels, burrs, blades, oxisensors, compression sleeves, catheters, bits, and saws. The cost of replacing these potentially reprocessable medical devices with new medical devices is substantially greater than the cost of cleaning and sterilizing the improperly discarded medical devices, so that they can be reused. It is unfortunate that through inadvertence and negligence, potentially reprocessable medical devices are placed into sharps containers that are simply destroyed. In contrast, the present invention recognizes that sharps containers may indeed include reprocessable medical devices and enables an operator to safely peruse the contents of a sharps container and efficiently sort the contents to recover the reprocessable medical devices, while any remaining non-reprocessable medical devices and other medical wastes are discarded and slated to be destroyed.

Hence, the result of this efficient sorting is that certain medical devices that have been used in a medical procedure by a medical care treatment facility and disposed of in a sharps container, may be recovered from the sharps container, cleaned, repackaged, resterilized, and reused by the medical care treatment facility. This recovery of reprocessable medical devices helps to lower or at least limit medical treatment care costs, especially considering the potential for certain medical devices to be reused multiple times.

Note that the term medical care treatment facility is not intended to in anyway be a limiting on the types of medical facilities that can be a source of the sharps containers that are processed with this invention. The term without limitation is intended to include hospitals, outpatient clinics, physicians' offices, nursing homes, medical clinics, dentists offices, blood banks, medical research facilities, laboratories, and any other facilities where medical devices are used that might be disposed of in a sharps container.

The Recovery Device

Figure 1:
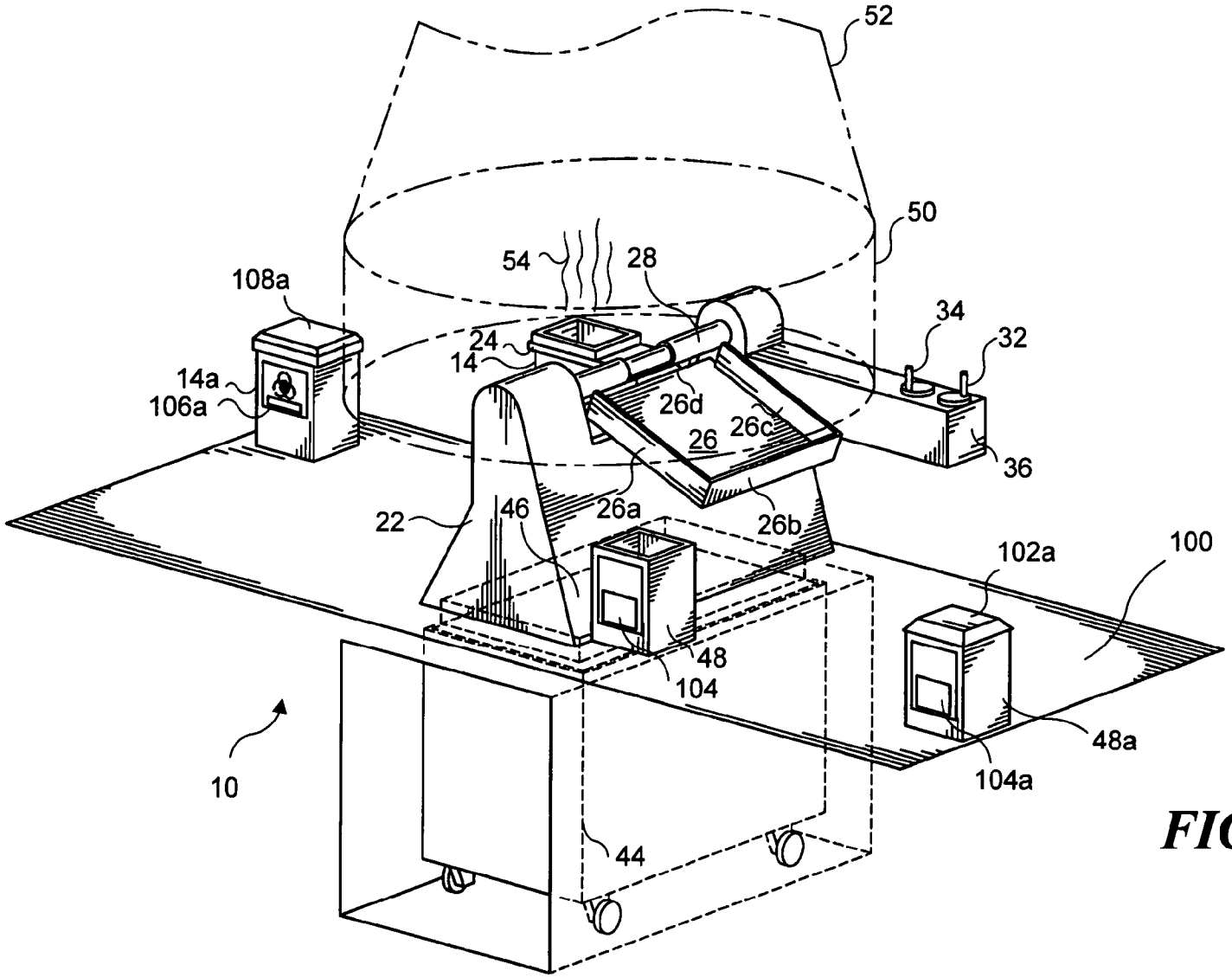
FIG. 1 is an overall isometric view of a preferred embodiment of the present invention that is used to separate SUDs that can be cleaned and reused from all other medical waste that should be destroyed, where SUDs are contained in a sharps container.

FIG. 1 is an isometric view of a preferred embodiment of a recovery device 10 that is used to sort the contents 12 (none of which are shown in this Figure) of a sharps container 14, to recover reprocessable medical devices (including those designated for multiple use and those designated as being reprocessable if processed by FDA approved agencies, leaving non-reprocessable medical devices and other medical waste that can then properly be disposed of permanently. The recovery device includes a frame 22, brackets 24, and a sorting surface 26. Frame 22 supports brackets 24 and sorting surface 26, both of which are movable about an axis 28 when actuated by an electrical prime mover or manually. Sharps container 14 is removably attached to brackets 24 by a latch (not shown). The brackets are mounted to rotate about axis 28 at a fixed distance such that once the left and right edges of the sharps container are aligned with the edges on the brackets, the sharps container may be slid into slots formed in the brackets and the latch then fastened. The latch ensures that the sharps container is secured to the brackets so that the sharps container can be securely rotated about axis 28.

Those skilled in the art will recognize that alternatives exist for both the brackets and latch. For example, clamps (not shown) could be used instead of the latch to hold the sharps container in place on the brackets. Also, plates (not shown) could be used to support the bottom and sides of the sharps container, which could be secured by one or more strap to the plates.

It will also be understood that either an electric motor or a hand-powered crank can alternatively be employed to drivingly rotate the sorting surface and the sharps container about axis 28, to any desired orientation. For example, the sharps container can be tipped sufficiently to enable any liquid contained in the sharps container to drain into a waste receptacle 44, and when positioned in a fully inverted orientation, the contents of the sharps container will be dumped onto the sorting surface. Although illustrated in FIG. 1 as an enclosed gear box 36 that includes a transmission for rotating sorting surface 26 about axis 28, and then rotating both sorting surface 26 and sharps container 14 about axis 28, it will be understood that in this embodiment, a hand crank 32 and a main crank 34 are used for manually applying the rotary motion conveyed through gear box 36 to rotate the sharps container and the sorting surface about axis 28. Hand crank 32 is cranked to manipulate the sorting surface to rotate about axis 28, while main crank 34 is cranked to manipulate the sharps container to rotate about axis 28.

However, those skilled in the art will recognize that manipulation of the sharps container and the sorting surface about axis 28 may be accomplished without the hand crank and the main crank. For example, as shown in FIG. 1, the enclosed gear box 36 may manipulate the sorting surface and the sharps container to rotate about axis 28 when driven by one or more electric motors that are controlled by the operator moving hand crank 32 and main crank 34, i.e., where the two cranks are simply control handles that actuate switches or even determine the speed of rotation applied by the one or more electric motors. The details of the drive system for rotating the sharps container and the sorting surface are not important in regard to practicing this invention, and those of ordinary skill will understand that the rotator motion may be applied and controlled in many different ways.

In a preferred embodiment, sorting surface 26 includes a side 26*a*, a side 26*b*, and a side 26*c*, with an open fourth side 26*d*. This open side enables any liquid in the sharps container to be drained into waste receptacle 44 after the reprocessable medical devices have been removed from the sorting surface. Open side 26*d* of the sorting surface also enables the non-reprocessable medical devices and the other medical waste to be deposited into waste bin 44 after all of the reprocessable medical devices have been removed from the sorting surface. Side 26*a*, side 26*b*, and side 26*c* of the sorting surface should also be of a height sufficient so that when the contents of the sharps container are dumped onto the sorting surface, the contents will not spill over the sides of the sorting surface. As an alternative, the sorting surface might include small perforations, similar to a grating, such that when the sorting surface and the sharps container are inverted, any liquid contents will drain through the perforations and into waste receptacle 44. The perforations should be sized to enable any liquid contents to drain yet prevent any solid contents of the sharps container from passing through the perforations.

Those skilled in the art will realize that although the sorting surface is shown in a square-shaped configuration, but shape of the sorting surface may vary as desired, so long as the size is sufficient to cover the opening formed when the lid of the sharps container is removed.

The sorting surface must be rotatably movable about axis 28, and is preferably readily removable, such that it can be periodically cleaned, disinfected, and repaired. In addition, although not shown in FIG. 1, in an alternative embodiment, the sorting surface may include protrusions such that when it is lowered onto the sharps container, the protrusions engage the walls of the sharps container in a clasped- or detent-like manner, thereby enabling the sorting surface and the sharps container to move together as either is rotated about axis 28. In contrast, the preferred embodiment first discussed above uses the hand crank to lock the sorting surface into position or disengage it from the sharps container, such that the main crank manipulates the combined sharps container and sorting surface about axis 28.

Frame 22 is preferably partially enclosed to ensure that the non-reprocessable medical devices and the other medical waste are directed towards waste bin 44 and do not readily escape onto the outer surface of the recovery device or onto a platform 100 surrounding the recovery device. However, at least a frame opening 46 is provided in platform 100 for enabling the remaining sorted waste materials and non-reprocessable medical devices (and any liquid) in the sharps container to drop into waste bin 44. This frame opening must be sized such that the non-reprocessable medical devices and the other medical waste can fall freely through the opening under the force of gravity. Thus, waste bin 44 is positioned under the frame to receive the non-reprocessable medical devices and the other medical waste, so that these items can be permanently destroyed—most likely by incineration.

In addition, frame 22 also includes a support for receptacle bin 48 that will receive the reprocessable medical devices removed by the operator from sorting surface 26. The receptacle bin is preferably disposed adjacent to the operator such that reprocessable medical devices may be speedily, safely, and efficiently transferred from the sorting surface to the receptacle bin for subsequent cleaning and sterilization.

Optional recovery device components that will ensure human safety and thus reduce exposure to biohazards include protective clothing (not shown) that is worn by the operator (including, optionally, a face mask with a supply of clean air), a shield 50 that overhangs the sharps container when initially fitted into the recovery device and the sorting surface, a vent 52, through which air from around and above the sorting surface is drawn, and a high-efficiency particulate arresting (HEPA) filter (not shown) that filters the air before it is exhausted to the outdoor ambient environment, so that any harmful pathogens are removed from the exhaust air. The operator will likely be garbed in protective gear in order to minimize contact with the sharps container biological and chemical contaminants. In addition, shield 50 will reduce the possibility of the operator being exposed to air-borne pathogens or aerosolized bio-contaminants or chemicals, as the sorting surface and sharps container are manipulated to rotate about axis 28 or while the operator is manually removing reprocessable medical devices from the sorting surface. Vent 52 also ensures that any pathogens or aerosolized harmful liquids in the sharps container such as fumes 54 are safely drawn away from the vicinity of the operator's working space.

Although a preferred embodiment only provides for the sorting of one sharps container at a time, those skilled in the art will recognize that the recovery device could be designed so that a plurality of sharps containers might be processed at one time to recover reusable medical devices for cleaning and sterilization. All of the sharps containers processed at one time would be from the same medical facility, to ensure that all of the reprocessable medical devices recovered from the sharps containers being processed at the same time are credited to the appropriate medical facility.

Method of Use

Figure 2:
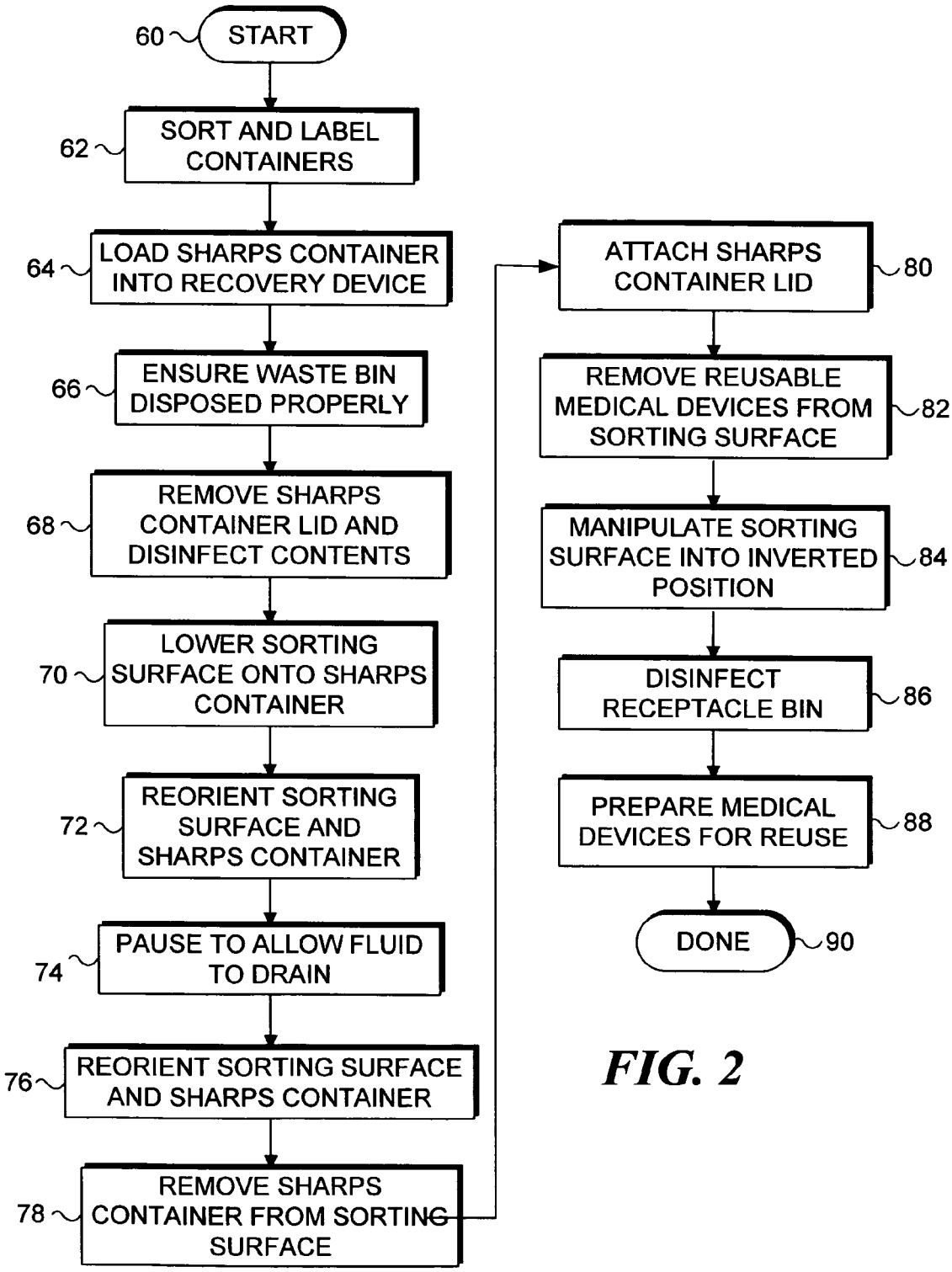
FIG. 2 is a block diagram showing the steps followed in the present invention to separate reprocessable medical devices from non- reprocessable medical devices that are contained in a sharps container.

FIG. 2 illustrates the logical steps implemented in connection with carrying out the method of the present invention. From a start block 60, a step 62 provides for sorting of all of the sharps containers by the medical care treatment facility and the department within the medical care treatment facility from which they were obtained. This is an important step, considering that the present invention should be very effective in helping medical care treatment facilities reduce their overall costs, since it will therefore be important to allocate the value of the reprocessable medical devices recovered from the sharps containers to their corresponding source medical department and medical treatment facility (or other source). It is very likely that operators at a recovery device center will be working with numerous sharps containers obtained from a number of medical care treatment facilities and other sources. Accordingly, the receptacle bin in which reprocessable medical devices are placed by the operator must be labeled appropriately with the name of the medical care treatment facility and/or department that is the source of the sharps container(s) from which the reprocessable medical devices placed in the recovery bin are derived. This information is available on the label on the outside of the sharps container. Similarly, a label is applied to the receptacle bin with the name and department of the medical care treatment facility that is the source of the sharps container being sorted.

A step 64 provides for loading the sharps container into the recovery device and securing it therein with the latch. A step 66 indicates that the operator should check that the waste bin is properly disposed underneath the opening in the frame so that all non-reprocessable medical devices and the other medical waste can be disposed of properly once the contents of the sharps container have been sorted to recover any reprocessable medical devices (and to receive any liquid contents of the sharps container). A step 68 provides for removing the lid of the sharps container and disinfecting the total contents by thoroughly spraying the interior and contents with a disinfectant spray. All visible surfaces should be sprayed with the disinfectant until moist. The lid is removed by lifting one end and sliding it clear of the sharps container (or as otherwise appropriate for the design of the sharps container being processed). Removing the lid of the sharps container only after the sharps container is in the recovery device ensures that the benefits described above in connection with the operator protective clothing, the shield, the vent, and the HEPA filter are achieved.

In a step 70, the sorting surface is lowered onto the sharps container in response to the operator turning the hand crank. The sorting surface is then held in place over the open top of the sharps container by the force applied with the hand crank, while the main crank is engaged by the operator to control the rotation of the sorting surface and the sharps container as a unit. Alternatively, the sorting surface can be held in place by the protrusions (not shown) that secure it to the walls of the sharps container, as described above. However, there will be some nominal clearance between the sorting surface and the sharps container so that there is not a complete seal between the sorting surface and the sharps container in order for the liquid contents to drain from the sharps container and into the waste bin when the sharps container is rotated sufficiently to partially invert the sharps container.

At this point, in a step 72, the main crank is utilized to reorient the sorting surface and the sharps container such that at a step 74, the operator can pause the combination sufficiently long to enable any liquid contents to drain through the clearance opening between the sorting surface and the open top of the sharps container. The operator, in a step 76, then reorients the sorting surface and the sharps container such that the sharps container is substantially fully inverted relative to its original position.

A step 78 then provides for removing the sharps container from the sorting surface using the main crank. At this point, the entire contents of the sharps container less the bulk of the liquid contents should be deposited onto the sorting surface. If any medical waste or medical device still remains within the sharps container, the operator can pause with the sharps container still partially inverted over the sorting surface and rap the sides of the sharps container, causing the remaining medical waste or medical device to fall on the sorting surface. Or, the operator may need to reach inside the partially inverted sharps container with tongs or other suitable instrument to grasp the medical waste or medical device remaining inside and deposit it on the sorting surface.

A step 80 provides for reattaching the sharps container lid and placing the empty sharps container into a queue for cleaning and sterilization, so that the sharps container can be recycled and returned to the medical care treatment facility for future use. A step 82 indicates that the operator then removes all reprocessable medical devices from the sorting surface. The operator may remove the reprocessable medical devices using tongs or any kind of device that enables the operator to firmly grasp the reprocessable medical device and safely place it into the receptacle bin. Only those medical devices that are deemed reprocessable or federally regulated so that only licensed agencies can process them for reuse will be removed from the sorting surface and placed into the receptacle bin.

In a step 84, after all reprocessable medical devices have been removed from the contents on the sorting surface, the operator rotates the sorting surface into an inverted position using the hand crank so that the non-reprocessable medical devices and remaining medical wastes are caused to slide from the sorting surface and drop down into the waste bin. At this point, it may be necessary for the operator to remove any non-reprocessable medical devices from the sorting surfaces manually using the tongs or similar implement if the non-reprocessable medical devices and medical waste clings to the sorting surface and does not readily drop into the waste bin.

A step 86 then provides for disinfecting the receptacle bin (once it is full or once all of the sharps containers from a given medical treatment facility have been processed to place their reprocessable medical devices into the receptacle bin). This receptacle bin may then be shipped to an outside facility, as noted in a step 88, where the reprocessable medical devices will be processed for reuse, which includes cleaning, sterilizing, and repackaging, or alternatively, the receptacle bin will remain at the recovery device center for similar processing. At this point, the recovery process is completed as indicated in a step 90.

Figure 3:
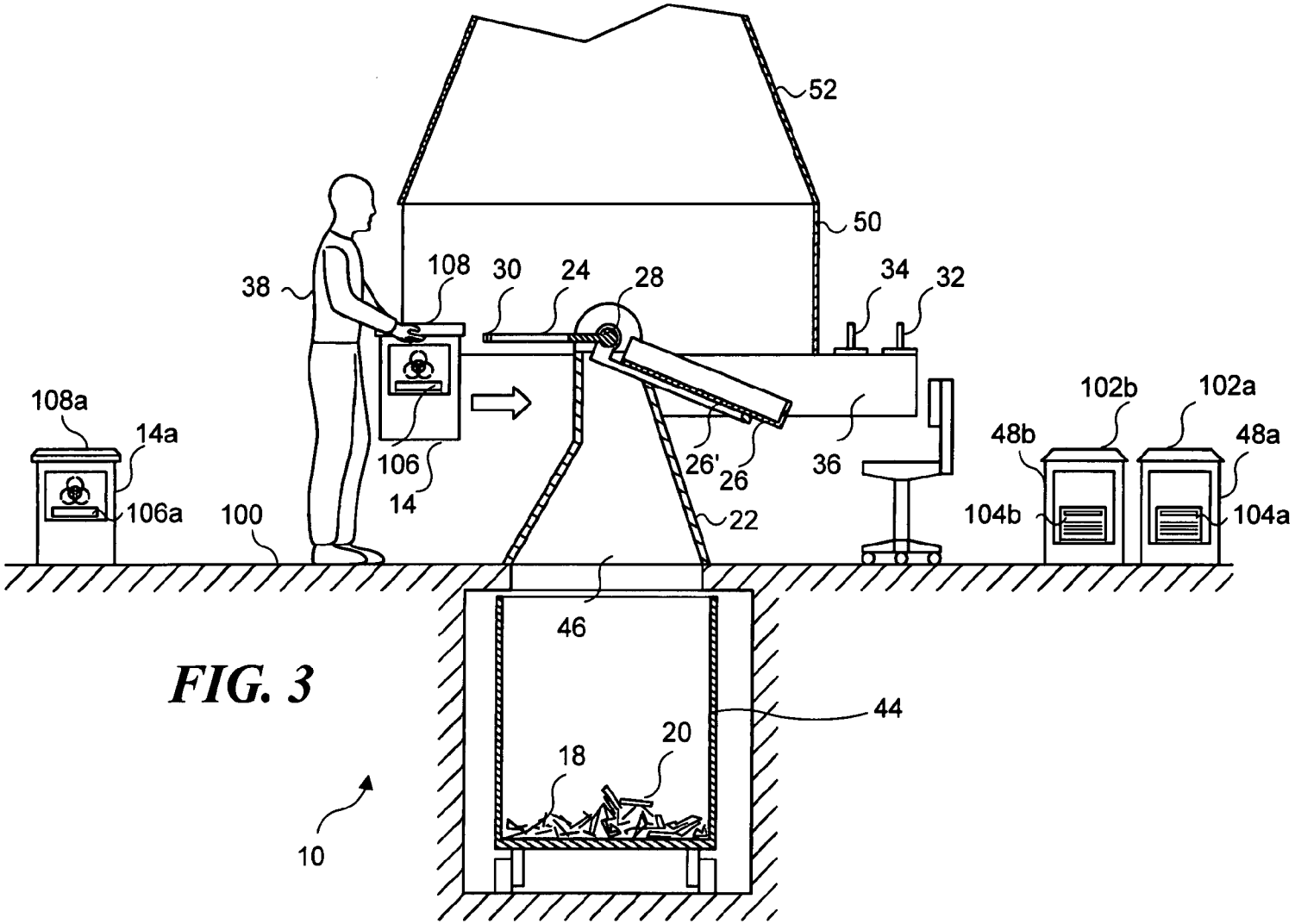
FIG. 3 is a schematic plan view of a sharps container being loaded into the recovery device at that the beginning of a sorting cycle that enables an operator to separate reprocessable medical devices from non-reprocessable medical devices.

FIGS. 3-9 illustrate the various steps of the method discussed above. For example, FIG. 3 illustrates a sharps container 14 as it is about to be loaded into the recovery device by an operator 38 who stands on platform 100; another sharps container 14*a* is in the sorting queue and is next to be processed. This Figure also illustrates the cyclical nature of the sorting routine performed by the recovery device, since it shows sealed receptacle bins 48*a* and 48*b* that are in the queue for post sorting processing. A lid 102*a* and a lid 102*b* are secured on receptacle bin 48*a* and receptacle bin 48*b*, respectively, and thus indicate that they contain reprocessable medical devices that have already been recovered by sorting through the contents of one or more sharps container and are ready for post sorting cleaning, sterilization, and packaging, and the value will be allocated to the appropriate medical facility and department as indicated on a label 104*a* and a label 104*b*, respectively. Waste bin 44 is partially full of non-reprocessable medical devices 18 and other medical waste 20 from earlier sorting of sharps containers. Once waste bin 44 is full, it will be removed, the contents destroyed, the waste bin will be cleaned and sanitized. An empty waste bin will then be disposed beneath the recovery device.

Although platform 100 is shown in all the figures, those skilled in the art will realize that frame 22 can be easily designed in an alternative configuration such that it completely encloses the waste bin, which is removable by opening an access panel. Therefore, operator 38 does not need to stand on the platform in this alternative embodiment in order to manipulate the recovery device and sort through the contents of the sharps container.

Prior to being loaded into recovery device 10, as described above, the label on the sharps container will have been noted and the receptacle bins will be labeled to indicate the source of the recovered reprocessable medical devices sorted from the contents of the sharps container, based upon the label of the sharps container. For example, a label 106*a* on a sharps container 14*a* might be appropriately labeled, "Caution, Biohazard, Infectious Waste, Metropolis City Hospital—Heart Surgery Department." Similarly, the label on the receptacle bin that will be used to receive the reprocessable medical devices sorted from the contents of sharps container 14*a* will be labeled to indicate that the source of the reprocessable medical devices contained therein is the Metropolis City Hospital—Heart Surgery Department.

Operator 38, who is garbed in protective gear (not shown), is illustrated securely mounting sharps container 14 into recovery device 10 by sliding the edges of the sharps container onto brackets 24 and securing it in place with a latch 30. A lid 108 of the sharps container is still secured to sharps container 14 that is being mounted onto the brackets. Notice that a lid 108*a* is still secured to sharps container 14*a* that will be sorted after sharps container 14 has been sorted.

Figure 4:
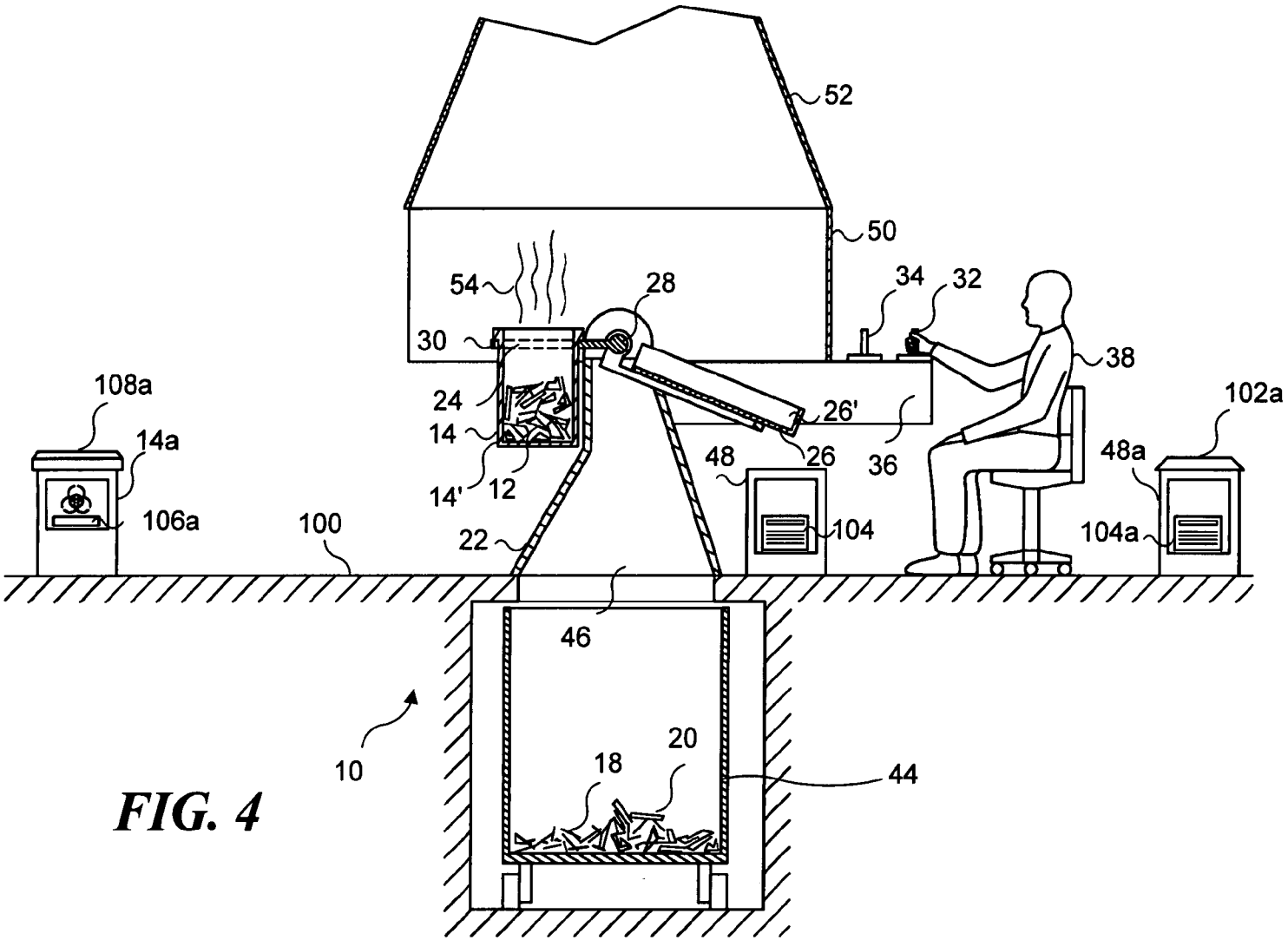
FIG. 4 is a schematic plan view of an operator manipulating the sorting surface over an opening in a sharps container that has been loaded into the recovery device.

In FIG. 4, sharps container 14 is shown after it has been mounted to brackets 24 and fastened upright in the recovery device. Although this step is not shown, operator 38 has removed the lid from sharps container 14 by lifting and sliding it clear of the sharps container, as is evident by fumes 54 that are wafting up from contents 12 of the sharps container. The operator has set the lid off to the side and it is not shown in this Figure. At this point, operator 38 sprays the contents of sharps container 14 with a disinfectant. This disinfectant should cover and wet all surfaces of the contents and the interior of sharps container 14 that are visible, including all surfaces of reprocessable medical devices, non-reprocessable medical devices, and other medical waste until all these items are visibly moist. Vent 52 and the HEPA filter (not shown) are then used to draw any pathogens and aerosolized bio-contaminants up and out of the region under shield 50, so that operator 38 may work in as safe an environment as possible.

Figure 5:
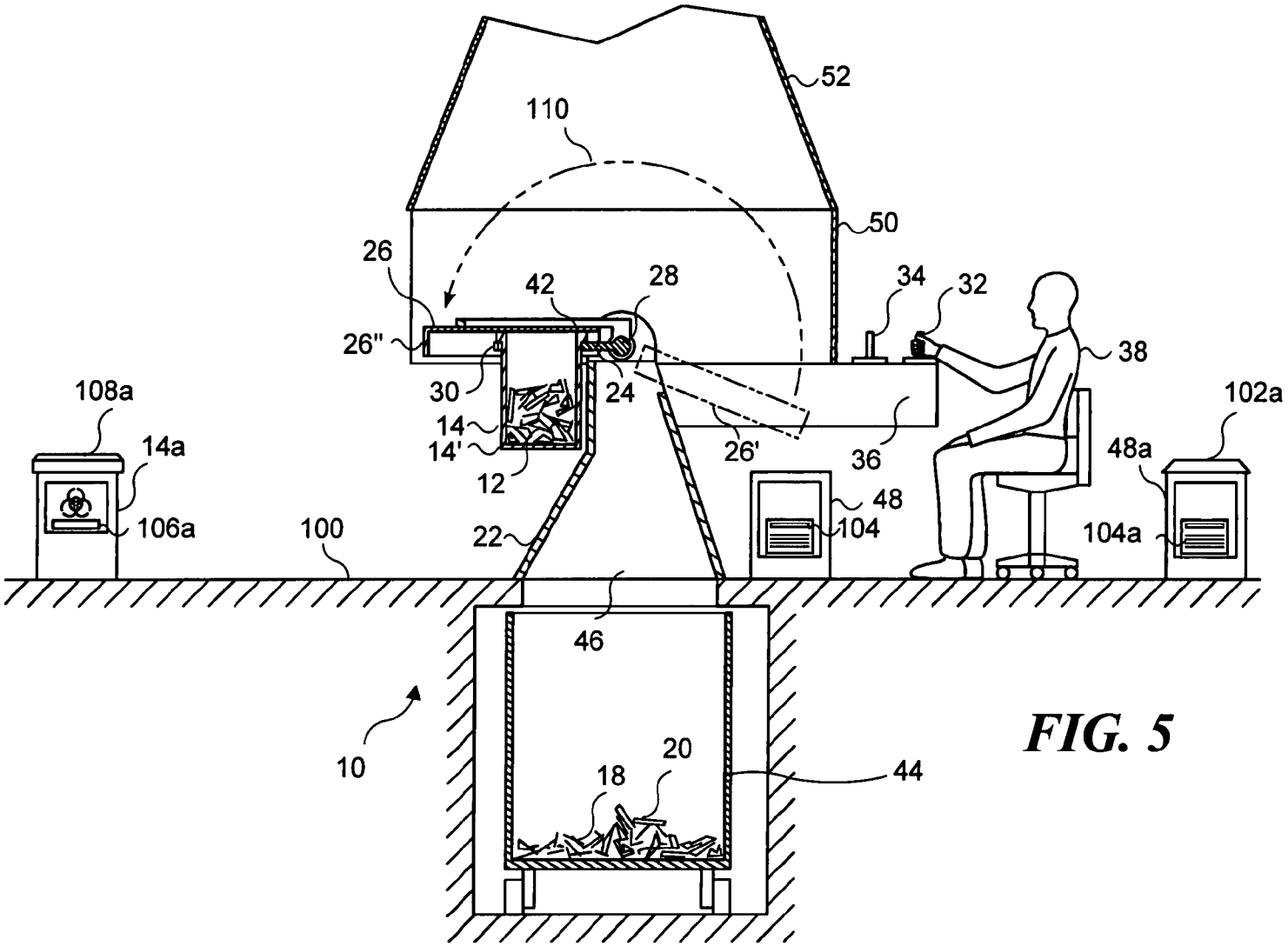
FIG. 5 is a schematic plan view showing how the operator manipulates the recovery device so that the sorting surface is rotated about an axis to be disposed atop the sharps container.

At this point, operator 38 begins to change the orientation of the sorting surface. In this preferred embodiment, the two cranks are manually activated by the operator to change the orientation of sorting surface 26 and then the combined sorting surface and sharps container 14. Activation of hand crank 32 on the recovery device enables sorting surface 26 to be rotated from an initial position 26', as shown in FIG. 4, and lowered onto the open top of sharps container 14 into a position 26", as shown in FIG. 5. As illustrated in FIG. 5, the range of rotational movement of the sorting surface is indicated by an arc 110, as sorting surface 26 is rotated about axis 28 from its initial position 26' by the operator turning hand crank 32, until sorting surface 26 rests on top of sharps container 14 in position 26". Note that sorting surface 26 is sized such that it covers the entire open top of sharps container 14. Although it is not shown, the sorting surface may have protrusions on its surface so that when the sorting surface is lowered onto the sharps container, the protrusions engage the walls of the sharps container. Alternatively, the hand crank disengages from acting upon the sorting surface and simply holds the sorting surface into contact with the top of the sharps container, once the sorting surface rests atop the sharps container, so that main crank 34 rotates both the sharps container and the sorting surface when actuated by the operator.

However, regardless of the method that is used to ensure that the sorting surface and the sharps container are temporarily engaged, the sorting surface is positioned or aligned over the sharps container so that when the contents are upended onto the sorting surface, there is no spillage of the contents of the sharps container over the sides of the sorting surface.

Figure 6:
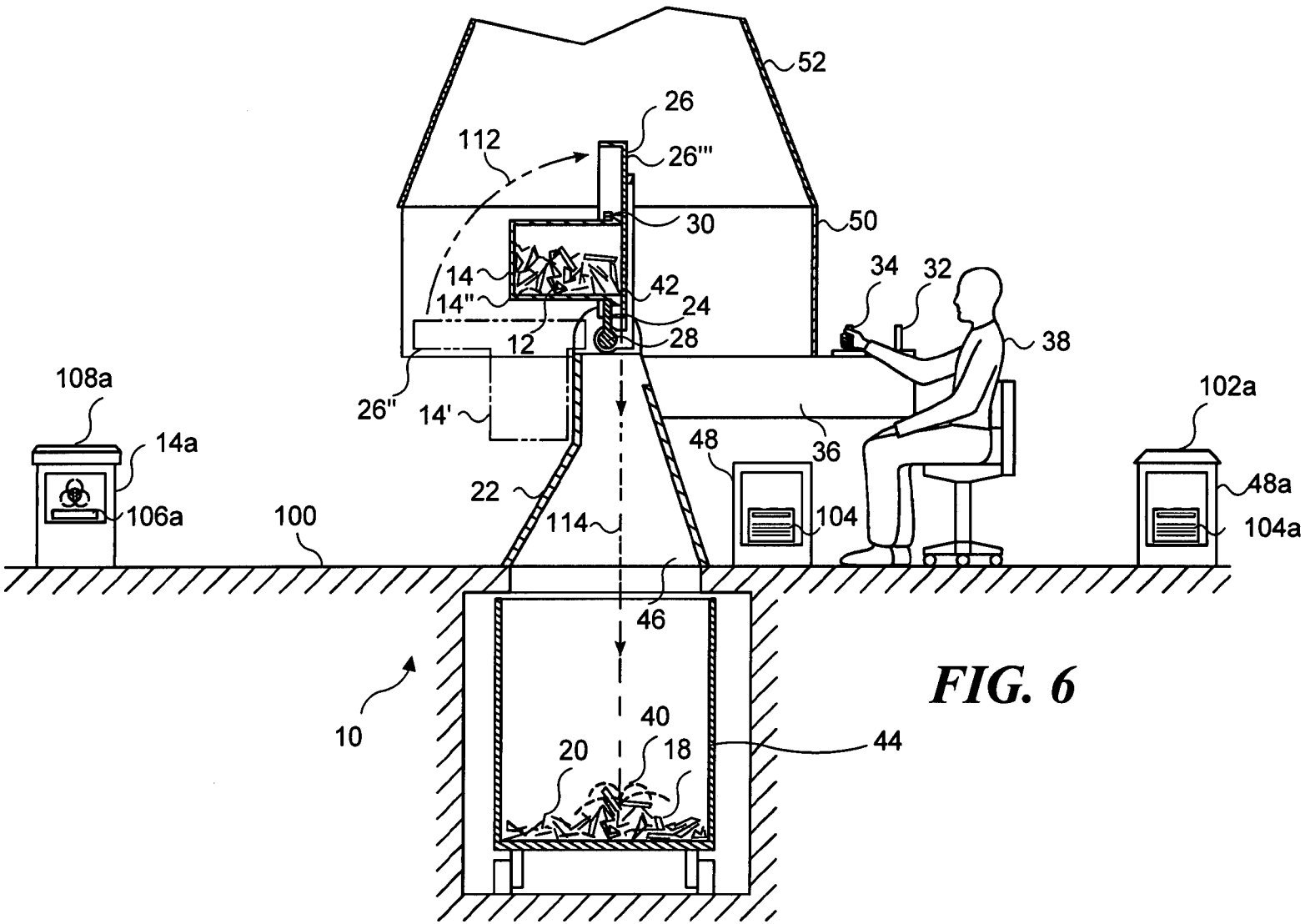
FIG. 6 is a schematic plan view showing how the operator manipulates both the sharps container and the sorting surface into a partially inverted position such that any liquid contents may be drained from the sharps container prior to emptying its contents for sorting.

With reference to FIG. 6, operator 38 is shown activating main crank 34 so that sharps container 14 and sorting surface 26 are rotating from positions 14' and 26", respectively, about axis 28 through an arc 112, to inverted positions, position 14" and position 26'", respectively. The purpose of partially inverting the sharps container and the sorting surface is to enable any liquid contents 40 within the sharps container to drain through opening 42 and into waste bin 44 through frame opening 46, as indicated by dash line 114. The liquid contents may also include blood, intravenous fluids, and residual chemicals from specimen tubes, flasks, and beakers, and any residual disinfectant. The waste bin is disposed immediately below frame 22 so that it will receive liquid contents 40 as they fall onto non-reprocessable medical devices 18 and other medical waste 20 from previously processed sharps containers. As described above, the recovery device cycles through multiple sharps containers, and it is likely that the waste bin will be used for multiple cycles of processing sharps containers until the waste bin becomes full.

Those skilled in the art will notice that although partially inverted positions, position 14" and position 26'" appear to form an angle slightly greater than 90 ° relative to position 14' and position 26", so that the opening into the sharps container is at its lowest point, various greater angles will also allow for drainage of the liquid contents from the sharps container. An alternative would be to rotate the sorting surface and the sharps container about axis 28 in arc 112 and then rapidly back in an opposite direction in order to jostle the contents of the sharps container, so that any liquid contents trapped therein would be allowed to escape and drain into waste bin 44.

In order to enable the liquid contents to drain, the sorting surface does not seal against the top of the sharps container, and instead forms opening 42 between the top of the sharps container and the sorting surface. Opening 42 is sufficiently large to only enable the liquid contents to be drained from the sharps container, but not so large that reprocessable or non-reprocessable medical devices are able to slide through the opening and into the waste bin.

Figure 7:
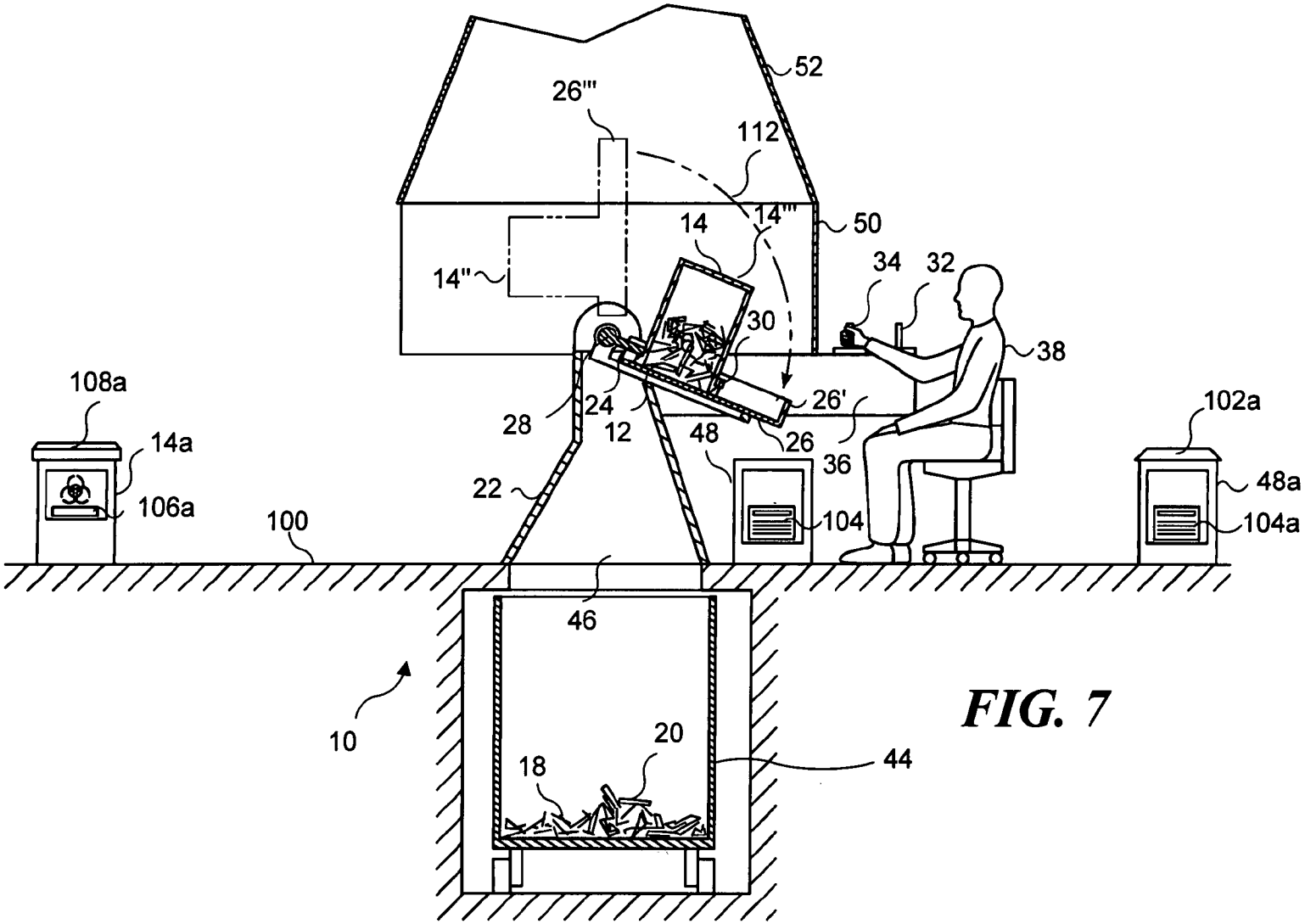
FIG. 7 is a schematic plan view showing the sharps container and the sorting surface manipulated into a position to dump the contents of the sharps container onto the sorting surface to facilitate sorting.

Once the operator has observed that there does not appear to be any more liquid contents 40 draining from the sharps container, the operator will then further rotate both the sorting surface and the sharps container as a unit into the respective positions shown in FIG. 7. Thus, the sharps container and the sorting surface continue rotating around axis 28 through arc 112 until the sharps container is substantially fully inverted in a position 14'" and the sorting surface is substantially in its initial position 26'. Medical devices and medical waste should be thus dumped onto sorting surface 26 from inside sharps container 14.

At this point, operator 38 will engage main crank 34 so that sharps container 14 is disengaged from the sorting surface and rotated about axis 28 along arc 110 in a controlled manner, as shown in FIG. 8. As sharps container 14 is rotated about axis 28, any remaining contents of the sharps container should be deposited onto the sorting surface, which is sized so as to contain all of the contents of the sharps container. Shield 50 is useful for protecting operator 38 from being splashed by residual liquid contents that were not disposed of earlier, that may escape from the sharps container or be aerosolized as the contents are upended onto the sorting surface. In the event that some of the total contents cling to the inside of the sharps container, the operator will manually remove these contents with tongs 56 (or other appropriate implement) and move the contents onto the sorting surface.

Once the sharps container has completed its rotational movement, it will be at its loading position 14', as shown in FIG. 8. Sharps container 14 may now have lid 108 replaced, and latch 30 can be opened to enable the sharps container to be removed from brackets 24. Sharps container 14 can now be put into a queue for cleaning and disinfecting so that it may be reused in a medical care facility.

Operator 38 will then sort through the reprocessable medical devices 16 and the non-reprocessable medical devices 18 in the sorting tray. Using tongs 56, operator 38 can reach between shield 50 and the top of sorting surface 26 and remove any reprocessable medical devices that may be resterilized, reprocessed, and repackaged, and thus available for reuse. The operator will then place the reprocessable medical devices into receptacle bin 48 that is disposed near the operator.

As shown in FIG. 8, the shield that is in front of the operator protects the operator from contaminants and is transparent, so that the operator can see the medical devices on the sorting surface. There is sufficient clearance between the sorting surface walls and the bottom of the shield, for the operator to reach under the bottom of the shield and the top of the front wall on the sorting tray and freely sort through the medical devices and wastes disposed on the sorting surface without being obstructed. In the alternative, the shield can be designed so that a portion of it can be repositioned and moved out of the way, in order to enable the operator better access to the sorting surface.

When operator 38 sees a reprocessable medical device that is suitable for cleaning and reuse, operator 38 will then place that reprocessable medical device into receptacle bin 48. The operator may use tongs 56 or any other implement that enables the operator to safely and securely grasp the medical device, since as mentioned above, the sharps container is intended to contain devices that are sharp, and therefore the operator could be injured by a sharp medical device if not properly handled. Some of the medical devices that may be reprocessed and deposited in receptacle bin 48 include, but are not limited to the following: trocars, laparoscopic devices, endoscopic devices, cutters, staplers, graspers, harmonic scalpels, burrs, blades, oxisensors, compression sleeves, catheters, bits, and saws.

Once the operator has retrieved all of the reprocessable medical devices and placed them into receptacle bin 48, the types of medical devices left behind on the sorting surface that cannot be reused include, for example: hypodermic needles, syringes with and without needles attached, scalpels, pipettes, blood vials, broken glassware such as flasks, beakers, and specimen tubes, culture dishes, IV tubing, IV bags contaminated with visible blood, and exposed dental wires. Other types of non-reprocessable medical devices and medical waste can also be left on the sorting surface.

Turning now to FIG. 9, operator 38 will engage hand crank 32 to rotate sorting surface 26 about axis 28 in arc 110 so that the sorting surface is in a partially inverted position 26"". Non-reprocessable medical devices 18 that were left behind on the sorting tray will then start to freely fall into waste bin 44, under the force of gravity, as indicated by dash line 114. The non-reprocessable medical devices will exit the sorting tray through opening **26*d*. Because of the nature of the medical waste and its associated fluids, it is very possible that some non-reprocessable medical devices may occasionally stick to the sorting surface, e.g., in residue that is formed thereon. At this point, operator 38 may manually remove these non-reprocessable medical devices and medical waste using tongs 56 or some other implement suitable for grasping or moving the non-reprocessable medical devices and medical waste into waste bin 44. The sorting surface is then returned to its original position 26'**.

Another sharps container from the same department and medical facility may be loaded into the recovery device if the receptacle bin is not full, as shown in FIG. 9. For example, if a heart surgery department of a specific hospital has submitted another sharps container to be sorted, as well as the sharp container that was just sorted, this additional sharps container may be processed and its reprocessable medical devices placed in receptacle bin 48 until the receptacle bin is full. Conversely, if no other sharps container from a given facility are available to process that day, or if receptacle bin 48 is full of reprocessable medical devices, receptacle bin 48 can then also be queued for reprocessing. The receptacle bin may have its contents cleaned, resterilized, and repackaged, and made ready for reprocessing at the recycling facility, in accordance with government regulations, so that it can be shipped by a common carrier without being labeled as biohazard infectious waste, which substantially reduces the cost of its transportation. In the alternative, the receptacle bin may be sealed and shipped to a remote facility for cleaning, resterilization, and repackaging for reuse of the contents.

If the next sharps container to be processed is from a different medical care facility, even though receptacle bin 48 is not full, it must be closed and queued since any reusable medical devices from the sharps container just processed should not be mixed with reusable medical devices in a sharps container from a different source. A new receptacle bin that includes an appropriate label corresponding to the label of the next sharps container will be disposed adjacent to the recovery device so that reusable medical devices from that sharps container may be placed in it during the next sorting cycle.

Although the present invention has been described in connection with the preferred form of practicing it and modifications thereto, those of ordinary skill in the art will understand that many other modifications can be made to the present invention within the scope of the claims that follow. Accordingly, it is not intended that the scope of the invention in any way be limited by the above description, but instead be determined entirely by reference to the claims that follow.

In the claims:

1. A method for recovering medical devices that can be processed for reuse from a sharps container, which includes other medical devices and medical waste materials that should be destroyed, comprising the steps of:

(a) engaging and manipulating sharps containers so as to enable safe access of contents of the sharps containers by an operator, while opening the sharps containers while the sharps container is in the recovery device;

(b) transferring the contents of the sharps containers to a sorting surface such that an operator is able to peruse and identify the medical devices that can be processed for reuse, for removal from the sorting surface; and (c) Recovering and processing said medical devices for reuse such that the medical devices remain substantially intact throughout the step of processing and reuse such that they are neither dismantled nor destroyed and so that they remain substantially complete.

2. A method for recovering medical devices that can be processed for reuse from a sharps container, which includes other medical devices and medical waste materials that should be destroyed, comprising the steps of:

(a) placing the sharps container in a recovery device that facilitates handling of the sharps container and its contents in a manner that protects an operator from exposure to biohazards;

(b) opening the sharps container while the sharps container is in the recovery device;

(c) using the recovery device, emptying the contents of the sharps container onto a sorting surface that is disposed adjacent to the operator;

(d) enabling the operator to sort through the contents and manually remove any medical devices that are suitable for processing and reuse from the sorting surface, to an adjacent location;

(e) depositing medical devices and medical waste that remain on the sorting surface, in a disposal container; and (f) processing the medical devices that are suitable for processing and reuse such that they are neither dismantled nor destroyed and so that they remain substantially complete.

3. The method of claim 2, further comprising the step of identifying a source of each sharps container that was submitted for disposal before the sharps container is placed in the recovery device, so that all medical devices that are removed from the sharps container for processing and reuse are attributed to the source.

4. The method of claim 2, wherein the step of processing further comprises the step of collecting any medical device that has been manually removed from the sorting surface in a receptacle.

5. The method of claim 4, further comprising the step of cleaning and disinfecting medical devices collected in the receptacle, to enable the medical devices that are thus cleaned and disinfected to be shipped by a common carrier, without being labeled as biohazard infectious waste, in accordance with government regulations.

6. The method of claim 4, further comprising the steps of shipping the medical devices that have been cleaned and disinfected to a remote facility; and further cleaning and processing the medical devices for reuse at the remote facility.

7. The method of claim 2, further comprising the step of applying a disinfectant to the contents of the sharps container before the step of emptying the sharps container.

8. The method of claim 2, further comprising the step of positioning the sharps container such that any liquid contained within the sharps container is drained into the disposal container, before the step of emptying the contents of the sharps container onto the sorting surface.

9. The method of claim 2, further comprising the step of exhausting air from a vicinity of the sharps container and the sorting surface so that any aerosolized pathogens are exhausted before contacting the operator.

10. The method of claim 9, further comprising the step of filtering the air that is exhausted through a filter that removes any pathogens carried by the air before the air is exhausted into an ambient environment.

11. The method of claim 2, wherein the step of using the recovery device to empty the sharps container comprises the steps of:

(a) engaging the sharps container with the recovery device;

(b) manipulating the recovery device so as to position the sorting surface over an opening into the sharps container;

(c) further manipulating the recovery device to invert both the sharps container and the sorting surface so that the contents of the sharps container move from inside the sharps container, through the opening, and fall onto the sorting surface; and (d) moving the sharps container away from the sorting surface.

12. The method of claim 11, wherein the step of manipulating includes the step of enabling any liquid included in the sharps container to be deposited into the disposal container.

13. The method of claim 12, further comprising the step of manually removing any portion of the contents that has not fallen onto the sorting surface from the sharps container and onto the sorting surface.

14. The method of claim 13, further comprising the step of queuing the sharps container that has been emptied, for cleaning.

15. The method of claim 14, further comprising the step of placing a cover on the sharps container before the step of queuing.

16. The method of claim 15, further comprising the step of sterilizing the sharps container in preparation for its reuse.

17. The method of claim 2, further comprising the step of incinerating a contents of the disposal container.

18. The method of claim 2, wherein the medical devices that are suitable for cleaning and reuse include at least one of:

(a) a trocar;

(b) a laparoscopic device;

(c) an endoscopic device;

(d) a cutter;

(e) a stapler;

(f) a grasper;

(g) a harmonic scalpel;

(h) a burr;

(i) a blade;

(j) an oxisensor;

(k) a compression sleeve;

(1) a catheter;

(m) a bit; and (n) a saw.

19. A method for recovering medical devices that can be processed for reuse from a sharps container, which includes other medical devices and medical waste materials that should be destroyed, comprising the steps of:

(a) placing the sharps container in a recovery device that facilitates handling of the sharps container and its contents in a manner that protects an operator from exposure to biohazards;

(b) opening the sharps container while the sharps container is in the recovery device;

(c) draining any liquid contained within the sharps container into a disposal container;

(d) using the recovery device, emptying the contents of the sharps container onto a sorting surface that is disposed adjacent to the operator;

(e) enabling the operator to sort through the contents and manually move any medical devices that are suitable for processing and reuse from the sorting surface, to an adjacent location;

(f) depositing medical devices and medical waste that remain on the sorting surface, in the disposal container; and (g) processing the medical devices that are suitable for processing and reuse such that they are neither dismantled nor destroyed and so that they remain substantially complete.

20. A method for recovering medical devices that can be processed for reuse from a sharps container, which includes other medical devices and medical waste materials that are not reusable and should be destroyed, comprising the steps of:

(a) placing the sharps container in a recovery device that facilitates handling of the sharps container and its contents in a manner that protects an operator from exposure to biohazards;

(b) opening the sharps container while the sharps container is in the recovery device;

(c) using the recovery device, emptying the contents of the sharps container onto a sorting surface that is disposed adjacent to the operator, further comprising the steps of:

(i) engaging the sharps container with the recovery device;

(ii) manipulating the recovery device so as to position the sorting surface over an opening into the sharps container;

(iii) further manipulating the recovery device to invert both the sharps container and the sorting surface so that the contents of the sharps container move from inside the sharps container, through the opening, and fall onto the sorting surface; and (iv) moving the sharps container away from the sorting surface;

(d) enabling the operator to sort through the contents and manually remove any medical devices that are suitable for processing and reuse from the sorting surface, to an adjacent location;

(e) depositing medical devices and medical waste that remain on the sorting surface, in a disposal container; and (f) processing the medical devices that are suitable for processing and reuse such that they are neither dismantled nor destroyed and so that they remain substantially complete.

* * * * *